United States Patent [19]

Berrangé

[11] 4,019,825

[45] Apr. 26, 1977

[54] SOIL COMPACTOR

[76] Inventor: Aubrey Ralph Berrangé, 147 Marais St., Brooklyn, Pretoria, Transvaal, South Africa

[22] Filed: Nov. 21, 1975

[21] Appl. No.: 634,321

[52] U.S. Cl. ..... 404/133

[51] Int. Cl.[2] ..... E01C 19/34

[58] Field of Search ..... 404/122, 124, 133; 280/124 F

[56] References Cited

UNITED STATES PATENTS

| | | | |
|---|---|---|---|
| 2,909,106 | 10/1959 | Berrangé | 404/124 |
| 3,201,141 | 8/1965 | Bernstein et al. | 280/124 F |
| 3,782,753 | 1/1974 | Sweet et al. | 280/124 F |
| 3,802,718 | 4/1974 | Schaeff | 280/124 F |
| 3,833,237 | 9/1974 | Sweet et al. | 280/124 F |

*Primary Examiner*—Henry S. Jaudon
*Attorney, Agent, or Firm*—Haseltine, Lake & Waters

[57] ABSTRACT

A soil compactor comprises a non-circular tamping roller the axis of which performs a translatory oscillating motion during operation, mounted through a pneumatic suspension system to a draw frame. The springing characteristics of the suspension system are selected so that, in combination with the mass of the frame and the frequency of oscillation of the roller axis, the frame is substantially isolated from the vertical component of the oscillatory motion at a chosen speed.

1 Claim, 2 Drawing Figures

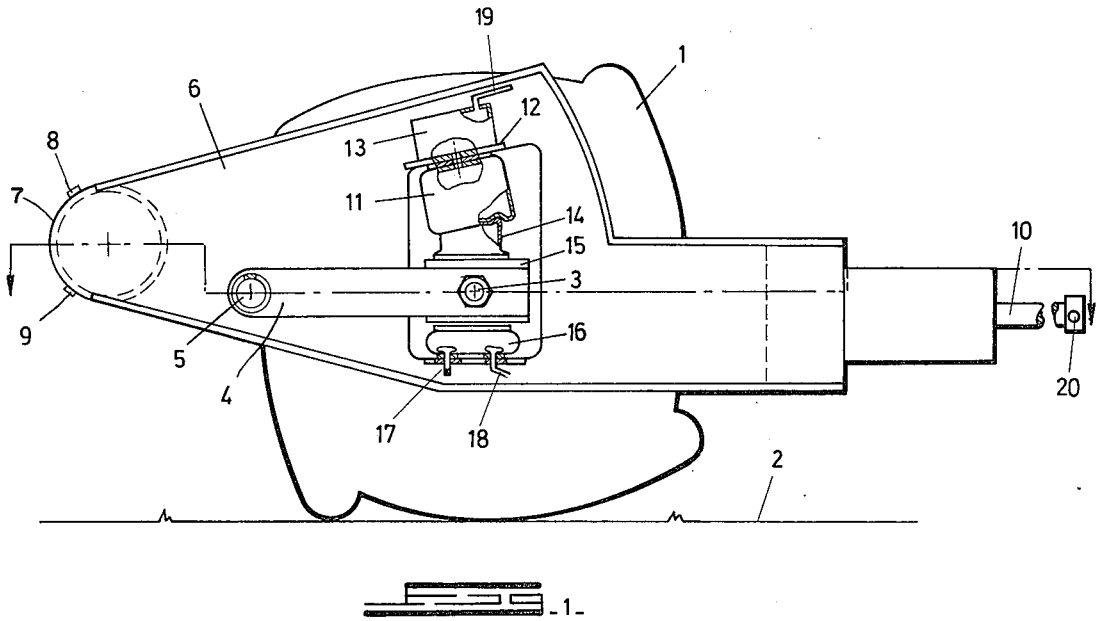
-1-
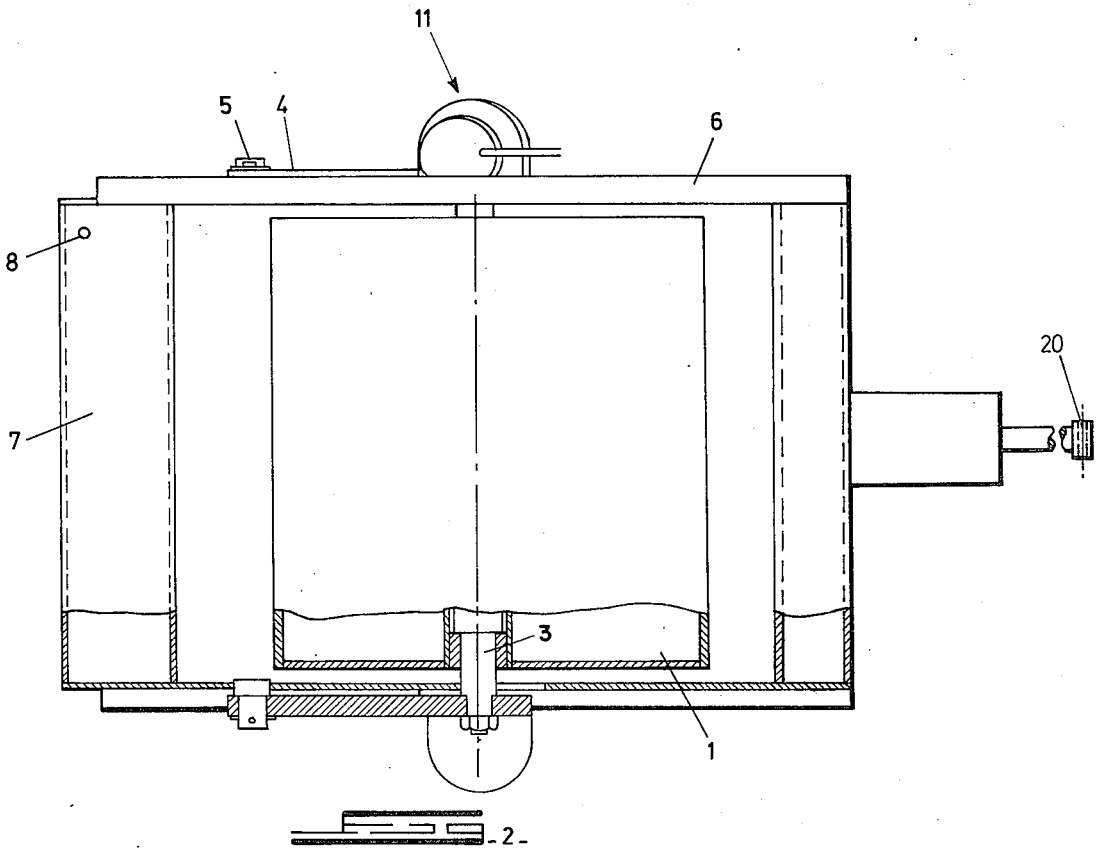
-2-

SOIL COMPACTOR

BACKGROUND OF THE INVENTION

This invention relates to a soil compactor which has a compacting roller adapted to perform a tamping action when drawn over a surface to be compacted, the axis of which roller performs a translatory oscillating motion during the tamping action, and the roller is mounted on a frame to which a drive force for pulling the roller is connected.

Impact compactors are known which consist of a non-cylindrical mass which, when drawn over the ground surface, produces a series of impacts. In operation, when drawn by a tractor, considerable jerk on the tractor is produced by the non-uniform motion of the mass. This jerk force has components in both the vertical and horizontal directions. Methods have been proposed to isolate the tractor from the horizontal component but isolation from the vertical component has remained a problem.

It is an object of the present invention to provide a soil compactor in which such isolation of the vertical component of the jerk force is achieved at a chosen speed of the soil compactor.

SUMMARY OF THE INVENTION

This object is achieved by the present invention providing a soil compactor having a tamping roller mounted on a draw-frame through a suspension system, the springing characteristics of which are selected, in combination with the mass of the frame and the frequency of oscillation of the roller axis, so that the frame is substantially isolated from the vertical component of the oscillating motion of the roller axis at a chosen speed of the roller.

The roller may have an axle the extremities of which are mounted on the frame through a pair of substantially horizontal crank arms, the extremities of the roller axle being keyed to one end of the crank arms and the other end of the crank arms being pivotally mounted on the frame, and the suspension system being provided between those ends of the crank arms to which the roller axle is keyed and the frame.

The suspension system may be pneumatic. It may comprise an air bag between each crank arm and the frame, the air bag being provided with a sufficient back-up volume to counteract variation of the spring force with compression of the air bag. Air cushions may further be provided between those ends of the crank arms to which the roller axis is keyed and the frame, the air cushions being located in opposed relationship to the air bags for damping vertical motion of the frame induced by severe oscillation of the roller axis during slow movement of the roller.

The air bags and air cushions are preferably located above and below the roller axis, respectively. Furthermore, the centre of percussion of the frame is preferably located in a vertical plane containing the roller axis.

In a further preferred embodiment, provision is made for ballast on the frame for fine adjustment of the centre of percussion of the frame to coincide with the plane containing the roller axis. Means may also be provided for varying the air pressure in the air bags during operation of the compactor for selecting suitable springing characteristics at a particular speed of operation.

DESCRIPTION OF THE INVENTION

The invention will now be described, by way of an example, with reference to the accompanying drawings, in which :

FIG. 1 is a side view of a soil compactor; and

FIG. 2 is a plan view of the compactor.

1 is a cam-shaped mass which when drawn along a ground surface 2 produces a series of impacts. Mass 1 is pivoted on an axle 3 which passes through its axis.

The extremities of axle 3 are journalled to a pair of crankarms 4, said crank arms being pivoted on stub-axles 5. Stub-axles 5 are mounted on the side members of frame 6 which straddles the roller mass 1.

7 is a cylindrical hollow member which forms part of the frame 6. A filler hole 8 and a drain hole 9 are provided for adjusting the amount of ballast carried in the cylindrical member 7.

A draw bar shaft 10 is connected by means of a springing system (not shown) to frame 6 to enable the frame to be hauled by a tractor. Haulage forces are transmitted from frame 6 via stub axles 5, crank arms 4 and axle 3 to the roller mass 1.

As the mass 1 rolls forward under the influence of the haulage forces the axle 3 rises from the lowest position which is shown in the diagram. As the rolling motion continues the axle oscillates up and down relative to the ground surface. An air spring 11 is provided at each end of the axle 3 but only one air spring 11 is shown in FIG. 2.

As the axle 3 rises from the position shown in the diagram it tends to compress the air spring 11 against a platform member 12 which is rigidly fixed to frame 6. The increased force exerted by the air spring 11 against platform member 12 induces upward acceleration of the frame.

The characteristics of air spring 11 are chosen such that at the normal frequency of oscillation of axle 3 in the vertical mode, the forces acting on frame 6 are insufficient to induce substantial vertical amplitude in frame 6.

To achieve the spring rate in air spring 11 to isolate the motion of frame 6 from axle 3 it is necessary to provide the air springs 11 with a substantial back-up volume 13. Air cylinder 13 and air spring 11 are directly connected by means of an air passage which does not restrict flow from one to the other.

14 is a bell shaped component of air spring 11 which is mounted on the crank arm by means of a platform member 15.

At certain speeds of rotation of roller mass 1 the frequency of vertical oscillation of axle 3 is such that large amplitudes of motion may be induced in frame 6. It is therefore necessary to provide some damping forces. These are provided in the form of an air cushion 16 which is fitted with an air pressure relief valve 17 set to discharge at a pre-set pressure.

Air cushion 16 is maintained in the inflated condition through an air supply pipe 18. Air at a chosen pressure for inflating the air spring 11 is supplied via pipe 19.

Whatever vertical motion of the drawbar frame 6 does occur, in spite of the springing mechanism described above, are prevented from producing vertical components of forces at the tractor hitch point 20 by virtue of the whole frame 6 being suspended about axle 3 at its centre of percussion relative to hitch point 20. To enable final trimming of the centre of percussion of the frame, provision is made for ballast in the cylindrical frame member 7.

I claim:

1. A soil compactor comprising a non-circular compacting roller adapted to perform a tamping action when moved over a surface to be compacted and a draw frame for the roller, the roller having an axle performing a translatory oscillating motion during the tamping action, a pair of substantially horizontal crank arms, the extremities of said axle being mounted on the draw frame through said pair of crank arms, by the corresponding ends of said crank arms, said extremities of the axle being journalled and the other corresponding ends of said crank arms being journalled to said frame, a pneumatic suspension system with upper and lower air cushions between the ends of the crank arms to which the roller axle is journalled and said frame, the upper air cushions comprising an air spring and being attached to said ends of said crank arms, the lower air cushions being free of said ends and comprising a buffer against excessive motion of the roller axle relative to said frame, said upper air cushions having air back-up volume means to counteract variation of the spring force with compression of the upper air cushions, the upper and lower air cushions being respectively located substantially above and below said roller axle.

* * * * *